US009643418B2

(12) United States Patent
Katagami et al.

(10) Patent No.: US 9,643,418 B2
(45) Date of Patent: May 9, 2017

(54) LIQUID DISCHARGING APPARATUS

(71) Applicant: SEIKO EPSON CORPORATION, Tokyo (JP)

(72) Inventors: Satoru Katagami, Matsumoto (JP); Tsutomu Sasaki, Matsumoto (JP); Manabu Suzuki, Matsumoto (JP); Kazutoshi Fujishima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/056,199

(22) Filed: Feb. 29, 2016

(65) Prior Publication Data

US 2016/0279948 A1 Sep. 29, 2016

(30) Foreign Application Priority Data

Mar. 26, 2015 (JP) ..... 2015-063917

(51) Int. Cl.

| | |
|---|---|
| ***B41J 2/165*** | (2006.01) |
| ***B41J 2/14*** | (2006.01) |
| ***B41J 2/17*** | (2006.01) |
| ***B41J 2/185*** | (2006.01) |

(52) U.S. Cl.

CPC ..... *B41J 2/165* (2013.01); *B41J 2/1433* (2013.01); *B41J 2/1714* (2013.01); *B41J 2/185* (2013.01); *B41J 2002/14443* (2013.01)

(58) Field of Classification Search

CPC ..... B41J 2/165; B41J 2/1714

See application file for complete search history.

(56) References Cited

U.S. PATENT DOCUMENTS

2004/0001119 A1* 1/2004 Johnson ..... B41J 2/16508 347/36
2007/0109348 A1* 5/2007 Izawa ..... B41J 2/1714 347/34
2009/0051725 A1* 2/2009 Ide ..... B41J 2/16532 347/23
2011/0181658 A1* 7/2011 Izawa ..... B41J 2/155 347/34
2012/0001985 A1 1/2012 Kumagai
2012/0007916 A1 1/2012 Kumagai (Continued)

FOREIGN PATENT DOCUMENTS

JP 03-208652 A 9/1991
JP 2007-229950 A 9/2007
JP 2008-093849 A 4/2008

(Continued)

OTHER PUBLICATIONS

European Search Report for Application No. 16160813.8 dated Nov. 4, 2016.

*Primary Examiner* — Alessandro Amari
*Assistant Examiner* — Roger W Pisha, II
(74) *Attorney, Agent, or Firm* — Workman Nydegger

(57) ABSTRACT

A liquid discharging apparatus includes multiple nozzle rows, in which a plurality of nozzles capable of discharging liquid onto a medium are arranged, that are arranged in an intersection direction intersecting with a nozzles-arranged direction where the nozzles are arranged, a shielding portion that shields an area between the nozzle rows, and a collecting portion that collects mist which is attached to the shielding portion and is generated due to discharging of the liquid from the nozzles.

11 Claims, 15 Drawing Sheets

(56) References Cited

U.S. PATENT DOCUMENTS

2014/0292921 A1* 10/2014 Tanaka ..... B41J 2/1714
347/34

FOREIGN PATENT DOCUMENTS

| | | | |
|---|---|---|---|
| JP | 2009-286078 | A | 12/2009 |
| JP | 2011-093281 | | 5/2011 |
| JP | 2014-100799 | | 6/2014 |

* cited by examiner

LIQUID DISCHARGING APPARATUS

BACKGROUND

1. Technical Field

The present invention relates to a liquid discharging apparatus.

2. Related Art

In the related art, a liquid discharging apparatus discharging liquid such as ink onto a medium, such as a recording medium is disclosed. In such a liquid discharging apparatus, there is a possibility that mist of liquid may be diffused an inside of the liquid discharging apparatus and the inside of the apparatus may be polluted. Therefore, a technology of suppressing diffusion of the mist is disclosed.

For example, in JP-A-2007-229950, the liquid discharging apparatus is disclosed which includes a collecting portion for collecting the mist so as to prevent the mist of the ink, which is generated due to discharging of the ink from a discharging portion, from being diffused.

In addition, recently, in order to improve a productivity, the liquid discharging apparatus, which includes nozzle rows in which a plurality of nozzles capable of discharging the liquid onto the medium are arranged, is used. In such a liquid discharging apparatus, for example, there is a case in which the mist of the liquid is diffused between the rows of nozzles such as heads in a upward direction and it causes an inside of the liquid discharging apparatus to be polluted, or the like. In addition, when intervals between the nozzle rows are buried so as to prevent the mist of the liquid from being diffused between the nozzle rows, there is a case that a defect, in which the mist of the liquid is attached to and remains in the intervals so that the remaining liquid is dropped on the medium and causes the medium to be polluted, is generated.

Moreover, in JP-A-2007-229950, it is not disclosed that the mist of the liquid discharged from the nozzles is diffused between the nozzle rows.

SUMMARY

An advantage of some aspects of the invention is provided to suppress mist of liquid discharged from nozzles from being diffused between nozzle rows in a liquid discharging apparatus including multiple nozzle rows in which the plurality of nozzles capable of discharging liquid onto a medium are arranged, without generating a defect.

A liquid discharging apparatus according to a first aspect of the invention includes multiple nozzle rows, in which a plurality of nozzles capable of discharging liquid onto a medium are arranged, that are arranged in an intersection direction intersecting with a direction in which the nozzles are arranged, a shielding portion that shields between the nozzle rows, and a collecting portion that collects mist which is attached to the shielding portion and is generated due to discharging of the liquid from the nozzles.

In the liquid discharging apparatus of a second aspect of the invention, the shielding portion includes an inclined portion which is inclined when seen from the nozzles-arranged direction.

In the liquid discharging apparatus of a third aspect of the invention, the collecting portion is provided on a downstream side of the inclined portion in a direction where the mist attached to the inclined portion flows.

In the liquid discharging apparatus of a fourth aspect of the invention, the shielding portion has a shape in which the mist attached to the inclined portion flows from a center side to an end portion side of the nozzle rows.

In the liquid discharging apparatus of a fifth aspect of the invention, the shielding portion has a shape in which the mist attached to the inclined portion flows from one nozzle row side toward the other nozzle row side among the nozzle rows.

In the liquid discharging apparatus of a sixth aspect of the invention, the collecting portion is detachable.

In the liquid discharging apparatus of a seventh aspect of the invention, the collecting portion includes a groove portion which extends in the nozzles-arranged direction and receives the liquid, and the groove portion is inclined when seen from the intersection direction.

A liquid discharging apparatus of an eighth aspect of the invention, further includes a carriage, in which the nozzle rows, the shielding portion, and the collecting portion are provided, that is capable of being reciprocated in the intersection direction, and when the carriage is positioned at a holding position in a reciprocating range of the carriage, the liquid received in the groove portion is removable from the groove portion.

In the liquid discharging apparatus of a ninth aspect of the invention, the collecting portion includes an absorbing member which absorbs the liquid.

In the liquid discharging apparatus of a tenth aspect of the invention, the collecting portion is the absorbing member which is bonded to the inclined portion.

In the liquid discharging apparatus of an eleventh aspect of the invention, the absorbing member is detachable.

According to the invention, in the liquid discharging apparatus including the nozzle rows in multiple in which the plurality of nozzles capable of discharging the liquid onto a medium are arranged, diffusing of the mist of the liquid discharged from the nozzles between the nozzle rows is suppressed without generating a defect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Example 1

FIG. 1 to FIG. 10

Hereinafter, a recording apparatus according to an example as a liquid discharging apparatus of the invention will be described in detail with reference to attached drawings.

First, an outline of a recording apparatus 1 according to Example 1 of the invention will be described.

Figure 1:
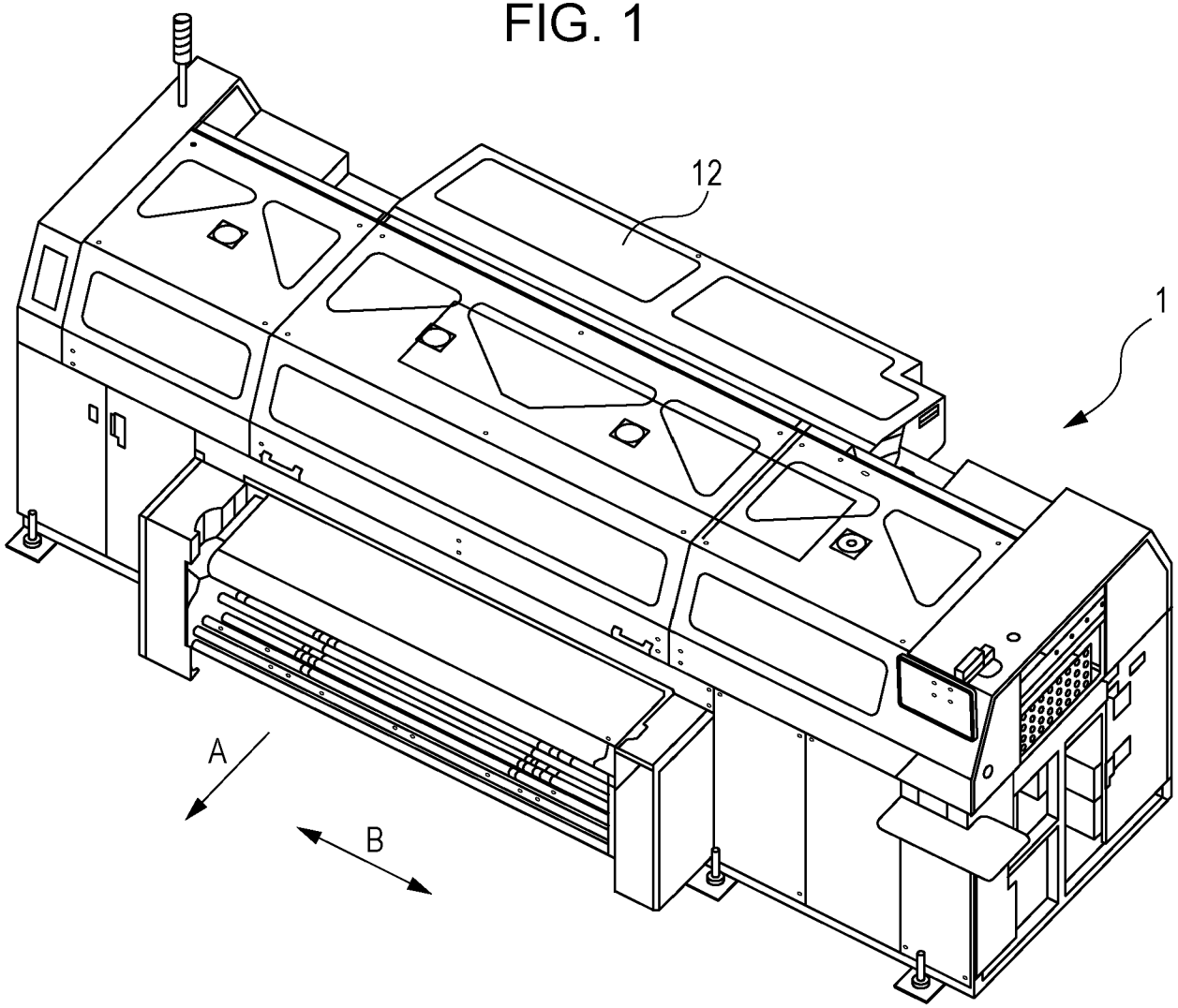
FIG. 1 is a schematic perspective view illustrating a recording apparatus of Example 1 of the invention.
Figure 2:
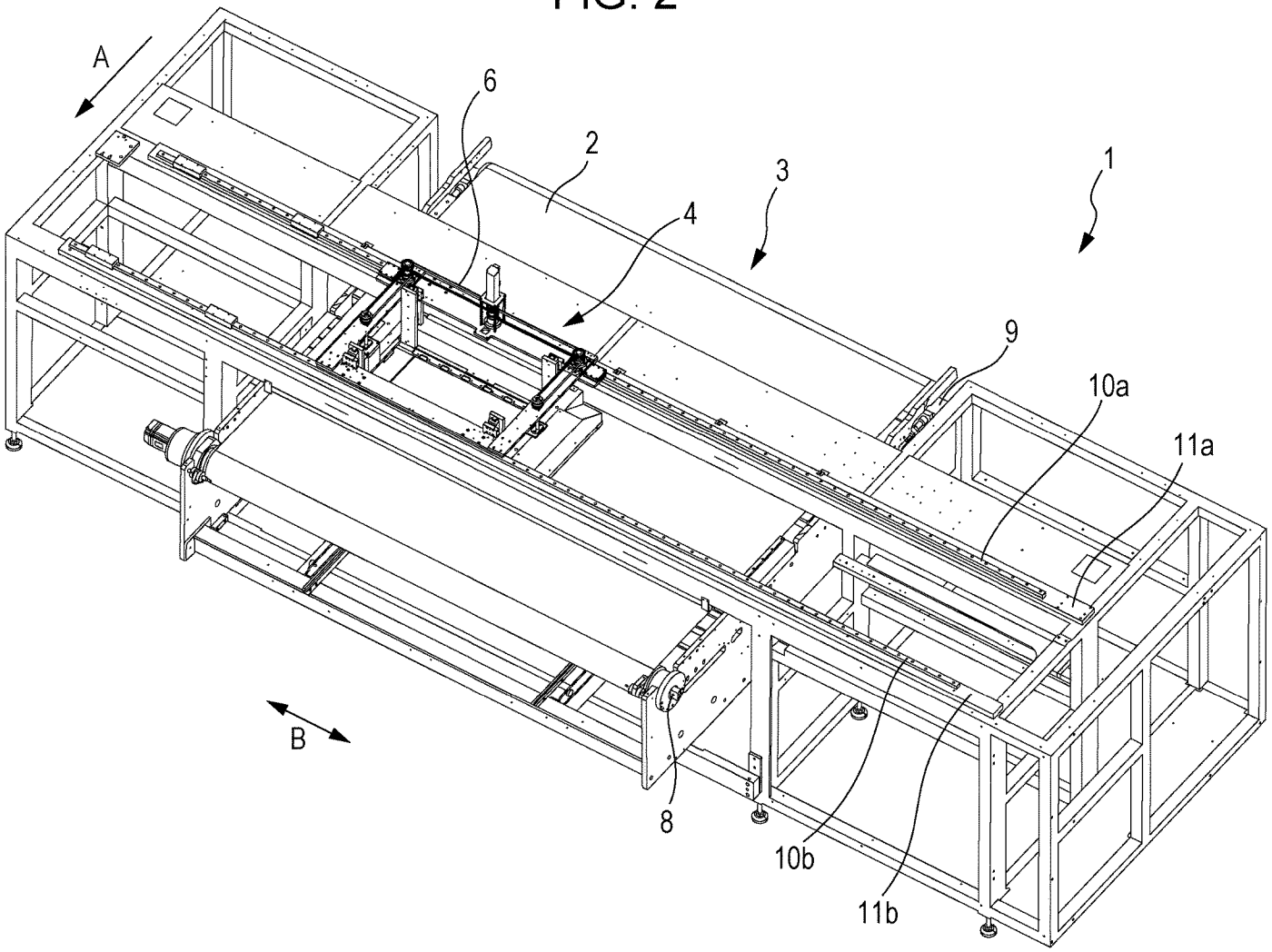
FIG. 2 is a schematic perspective view illustrating the recording apparatus of Example 1 of the invention.
Figure 3:
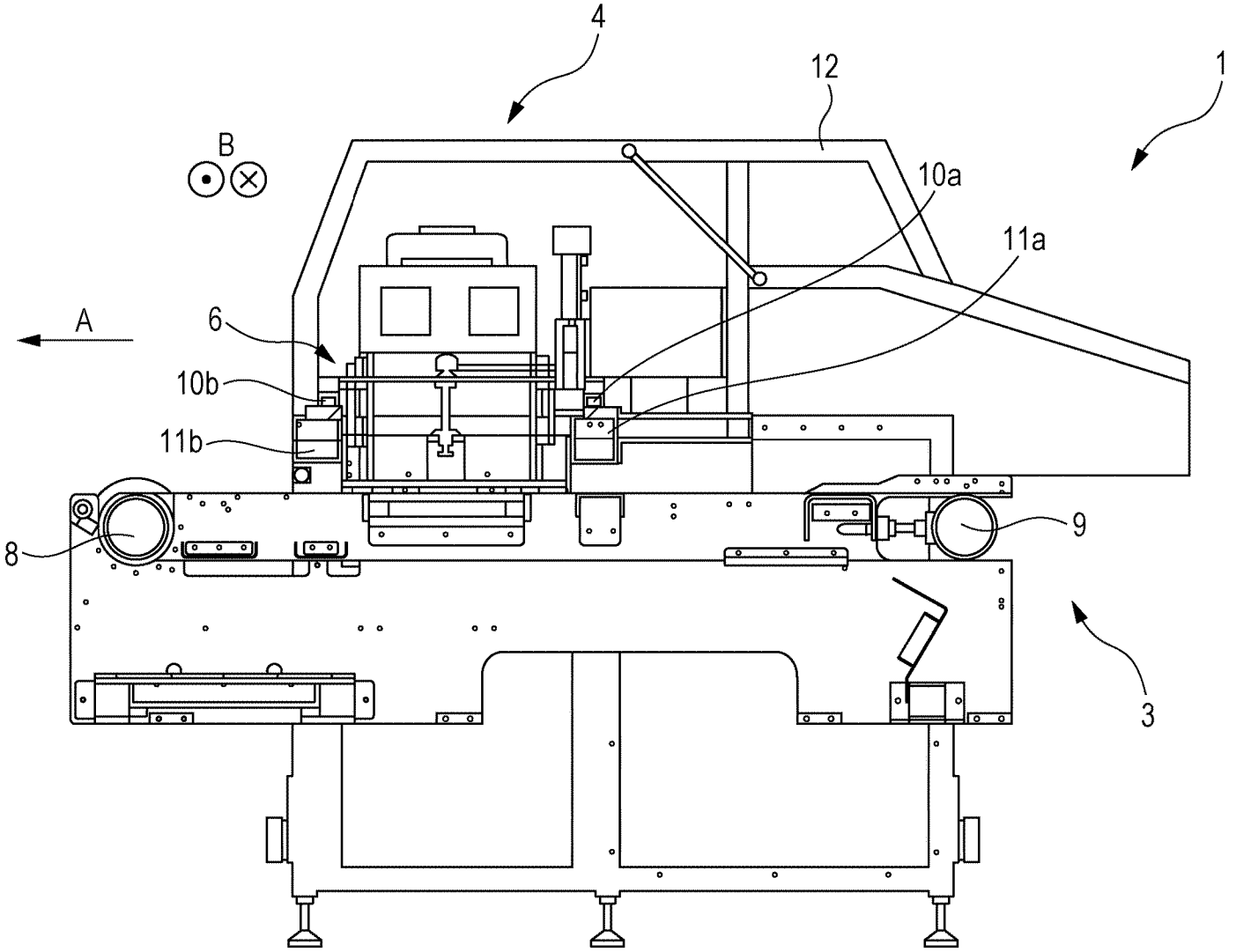
FIG. 3 is a schematic side sectional view illustrating the recording apparatus of Example 1 of the invention.

FIG. 1 and FIG. 2 are schematic perspective views of the recording apparatus 1 of the example. In addition, FIG. 3 is a perspective side sectional view of the recording apparatus 1 of the example. Also, FIG. 2 illustrates a state in which a part of a configuration member, such as a case body 12 is removed so as to easily describe an inside of the recording apparatus 1.

The recording apparatus 1 of the example includes a transportation mechanism 3 which transports a recording medium M in a transportation direction A by an adhesive belt 2 (endless belt) supporting the recording medium M (refer to FIG. 9) as a medium to a supporting surface attached with an adhesive. In addition, a feeding portion (not illustrated) is included therein which is capable of setting the recording medium M of a roll type and feeding the recording medium M to the transportation mechanism 3. In addition, a recording mechanism 4 is included therein which performs recording by reciprocating a carriage 6 including a recording head 7 (refer to FIG. 4) as a discharging portion to a transportation region of the recording medium M by the transportation mechanism 3 in an intersection direction B intersecting with the transportation direction A of the recording medium M. Further, a winding mechanism (not illustrated) is included therein, which is capable of winding the recording medium M on which recording is performed in the recording mechanism 4.

The transportation mechanism 3 of the example includes the adhesive belt 2 which mounts and transports the recording medium M fed from the feeding portion, a driving roller 8 which moves the adhesive belt 2, and a driven roller 9. The recording medium M is attached to and mounted on a supporting surface of the adhesive belt 2.

However, an endless belt as a transportation belt is not limited to the adhesive belt. For example, an electrostatic ally attracting endless belt may be used.

Moreover, the recording apparatus 1 of the example includes the transportation mechanism 3 having such a configuration; however, it is not limited to the transportation mechanism having such a configuration, and may have a configuration in which the recording medium M is transported by being supported with a movable supporting tray, or the like, or a configuration in which the recording medium M is transported by a pair of rollers, or the like. Also, a so called flatbed type recording apparatus may be used, which performs recording by fixing the recording medium M to the supporting portion and moving the recording head 7 to a fixed recording medium M.

The recording mechanism 4 includes a carriage motor 30 (refer to FIG. 8) which reciprocates the carriage 6 including the recording head 7 capable of discharging ink (liquid) in the intersection direction B.

The recording apparatus 1 of the example performs recording by reciprocally scanning the carriage 6 including the recording head 7 at the time of recording; however, during record-scanning (during moving of carriage 6), the transportation mechanism 3 allows transportation of the recording medium M to stop. When expressed in a different manner, at the time of recording, reciprocal scanning of the carriage 6 and transportation of the recording medium M are alternately performed. That is, at the time of recording, corresponding to reciprocal scanning of the carriage 6, the transportation mechanism 3 intermittently transports the recording medium M (the adhesive belt 2 is intermittently moved).

Moreover, a rail 10*a* extending in the intersection direction B is provided on a pipe 11*a* constituting a frame portion of the recording apparatus 1 of the example, and a rail 10*b* extending the intersection direction B is provided on a pipe 11*b* constituting the frame portion of the recording apparatus 1 of the example. In addition, bearing portions (not illustrated) are received in the rail 10*a* and the rail 10*b*, and thus, the carriage 6 of the example is guided to move in the intersection direction B along the rail 10*a* and the rail 10*b*.

Next, the carriage 6 of the recording apparatus 1 of the example will be described.

Figure 4:
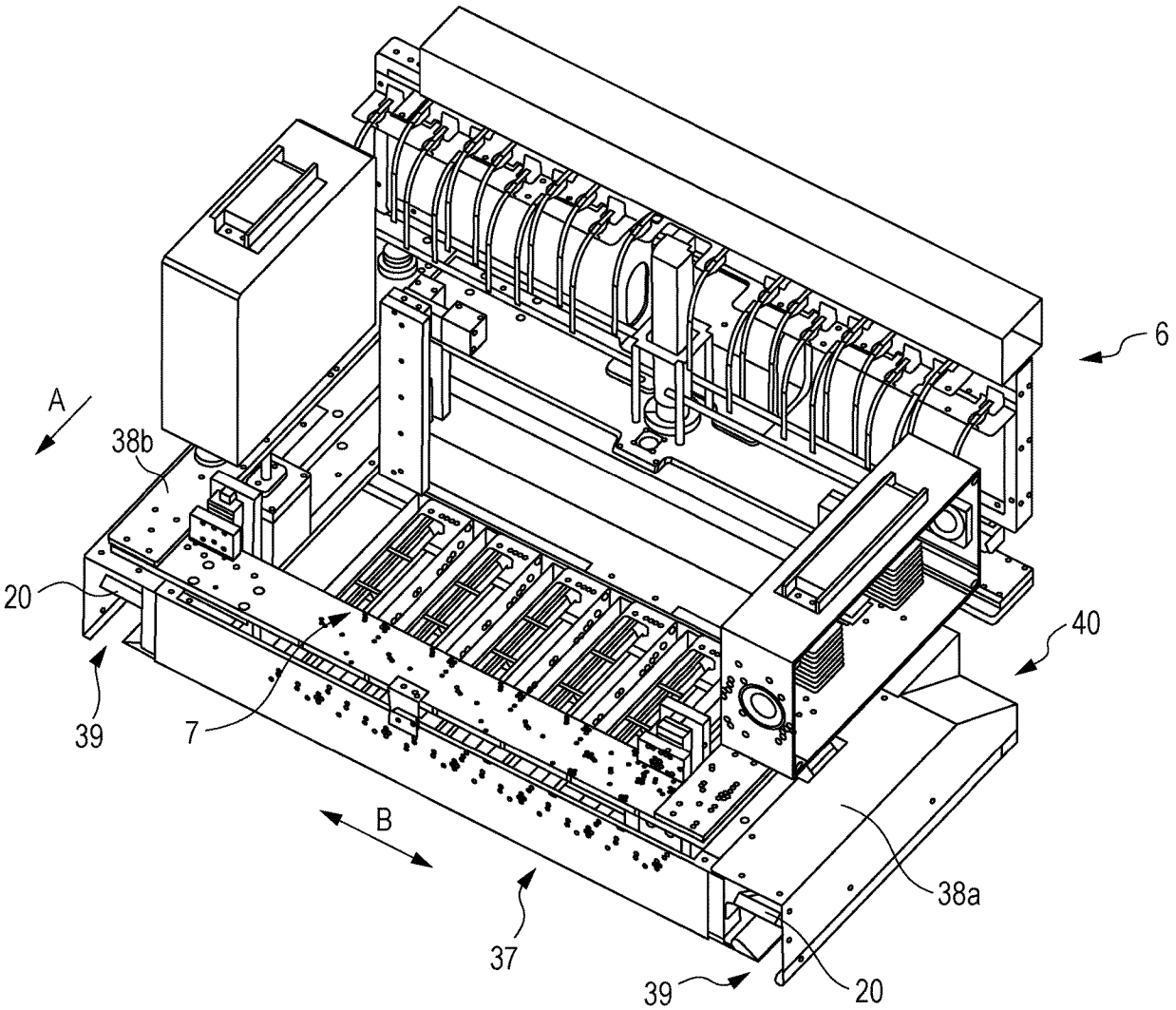
FIG. 4 is a schematic perspective view illustrating a carriage of the recording apparatus of Example 1 of the invention.
Figure 5:
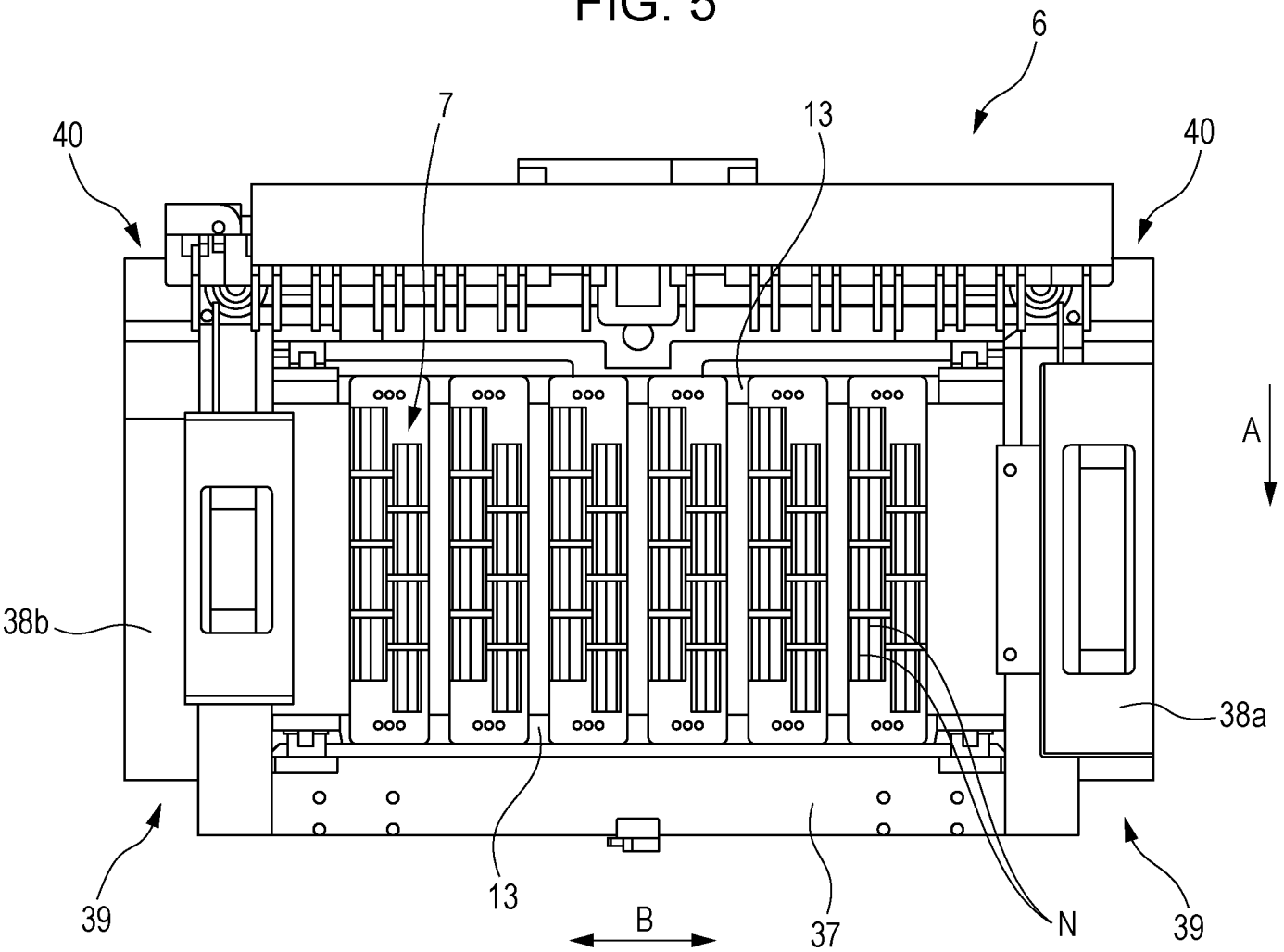
FIG. 5 is a schematic plan view illustrating the carriage of the recording apparatus of Example 1 of the invention.
Figure 6:
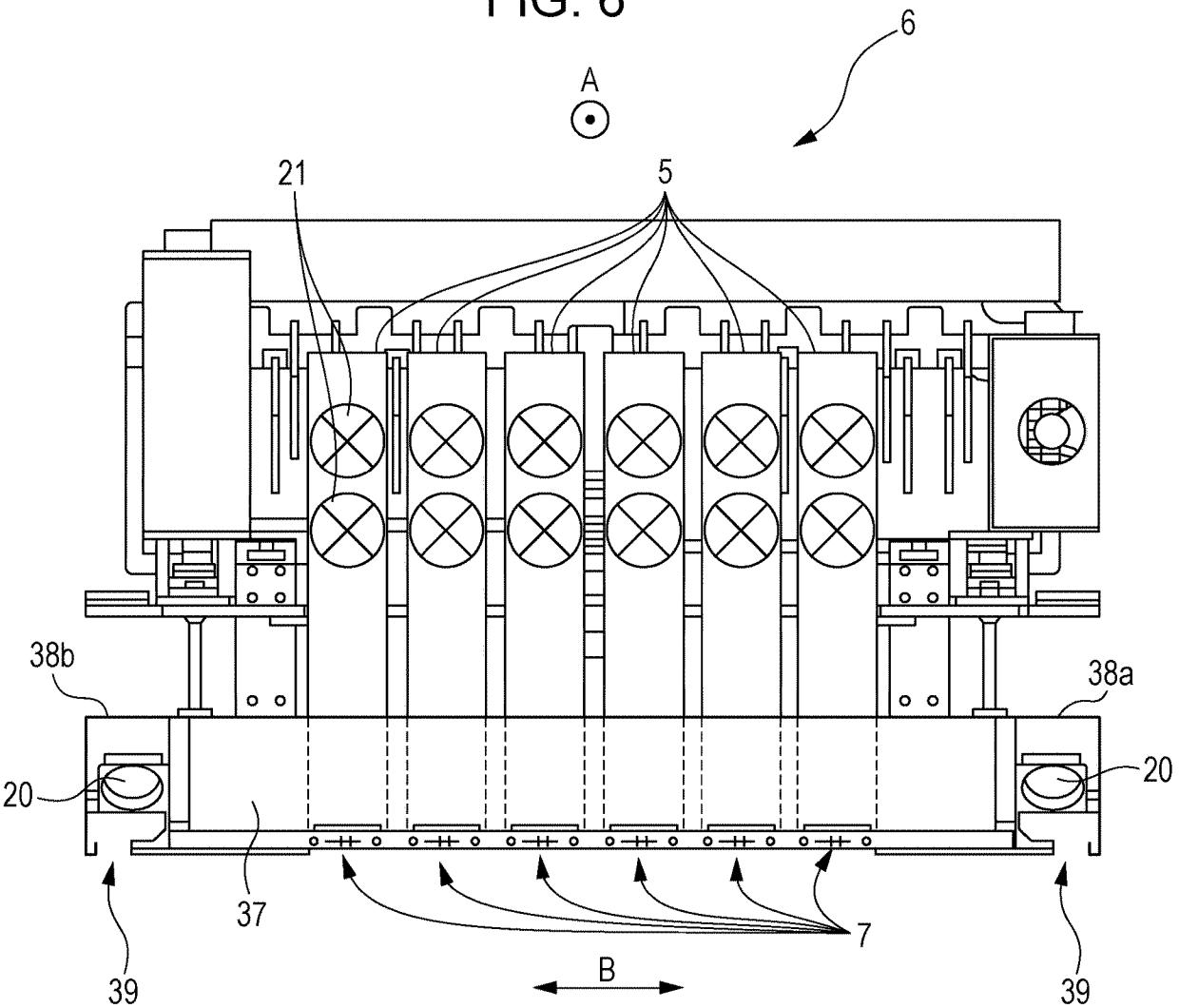
FIG. 6 is a schematic front view illustrating the carriage of the recording apparatus of Example 1 of the invention.
Figure 7:
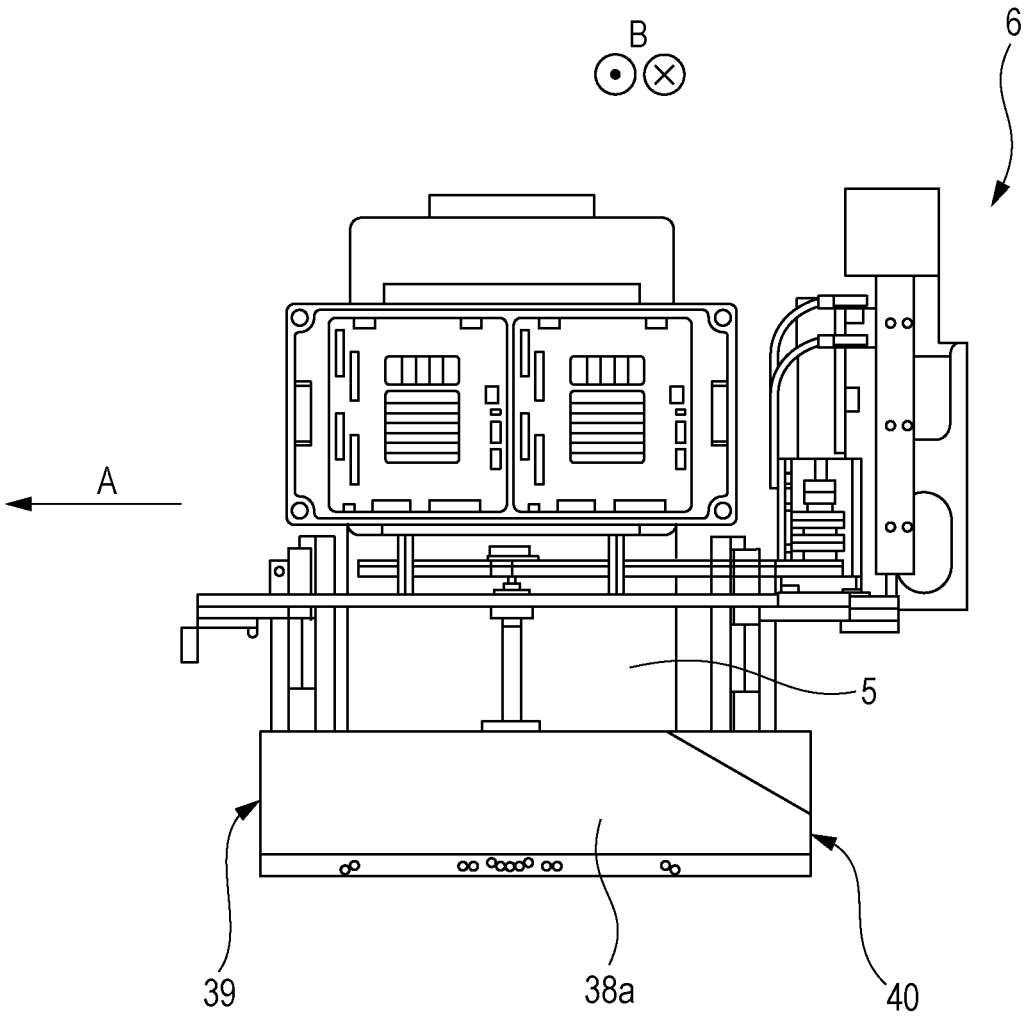
FIG. 7 is a schematic side view illustrating the carriage of the recording apparatus of Example 1 of the invention.

FIG. 4 to FIG. 7 illustrates schematic views of the carriage 6 of the example. Among these, FIG. 4 is a schematic perspective view of the carriage 6 of the example, FIG. 5 is a schematic plan view of the carriage 6 of the example, FIG. 6 is a schematic front view of the carriage 6 of the example, and FIG. 7 is a schematic side view of the carriage 6 of the example.

Moreover, in the carriage 6 of the example, sub-carriages 5 including a plurality of the recording heads 7 are provided on a plurality (six) of supporting portions 13, and FIG. 4 and FIG. 5 are perspective views illustrating an arrangement of the plurality of recording heads 7 provided in each of the sub-carriages 5.

In addition, in FIG. 4 to FIG. 7, a state in which a shielding portion 41 (refer to FIG. 9), which is a main part of the carriage 6 of the example to be described later, and a collecting portion 15 (refer to FIG. 9) are detached is illustrated in detail.

As illustrated in FIG. 5 and FIG. 6, the plurality (six) of sub-carriages 5 can be detachable to the carriage 6 of the example. As illustrated in FIG. 4 and FIG. 5, in each sub-carriage 5, the plurality of recording heads 7 are alternately arranged from each other (staggered). Here, as illustrated in FIG. 5, in each recording head 7, two nozzle rows N in each of which a plurality of nozzles discharging ink are arranged along the transportation direction A. Accordingly, in the recording apparatus 1 of the example, the transportation direction A can be also expressed as a nozzles-arranged direction A. Moreover, in addition to the plurality of recording heads 7, a substrate, and the like are provided in each of the sub-carriages 5, and as illustrated in FIG. 6, a sub-carriage fan 21 for cooling the substrate is provided therein.

Since the sub-carriage fan 21 suppresses an increase of a temperature inside the sub-carriage 5 by sending (blowing) the air to an inside of the sub-carriage 5, when mist Im of the ink (refer to FIG. 14) is in the vicinity of the sub-carriage fan 21, the mist Im is sent to the inside of the sub-carriage 5, and thus, there is a concern that the mist Im is attached to the substrate, and the like.

For this reason, in the recording apparatus 1 of the example, the mist Im of the ink discharged from the recording head 7 flies up, and a frame type portion 37, which is for suppressing that the mist Im reaches the vicinity of the sub-carriage fan 21 of the sub-carriage 5, is provided. The frame type portion 37 functions as a separator which suppresses flying-up of the mist Im with respect to a region where the mist Im near the recording head 7 is profuse and holds a region above the sub-carriage 5 in a region where the mist Im is small.

Further, airflow generation portions 38*a* and 38*b* in which a carriage fan 20 is respectively provided are provided in an outside of the frame type portion 37 in the intersecting direction B. When expressed in a different manner, in the airflow generation portions 38*a* and 38*b* provided on the outside of the frame type portion 37 in the intersection direction B, the carriage fan 20, which generates airflow toward an opening portion 40 provided at an upstream side of the transportation direction A, is provided in the vicinity of an opening portion 39 which is provided at a downstream side of the transportation direction A.

Here, the carriage 6 of the example drives the carriage fan 20, thereby making it possible to move the mist Im to a position (upstream side of transportation direction A) which does not overlap with the recording head 7 in a moving region of the carriage 6 when seen from the intersection direction B, by a control of the controller 23, during recording (during discharging the ink from the recording head 7 while moving the carriage 6 in the intersection direction B).

Such a carriage 6 of the example is provided with the frame type portion 37 and the airflow generation portions 38*a* and 38*b*, and particularly, has a configuration hardly affected by the mist Im. However, the invention is not limited to the recording apparatus including the carriage which has such a configuration.

Next, an electrical configuration in the recording apparatus 1 of the example will be described.

Figure 8:
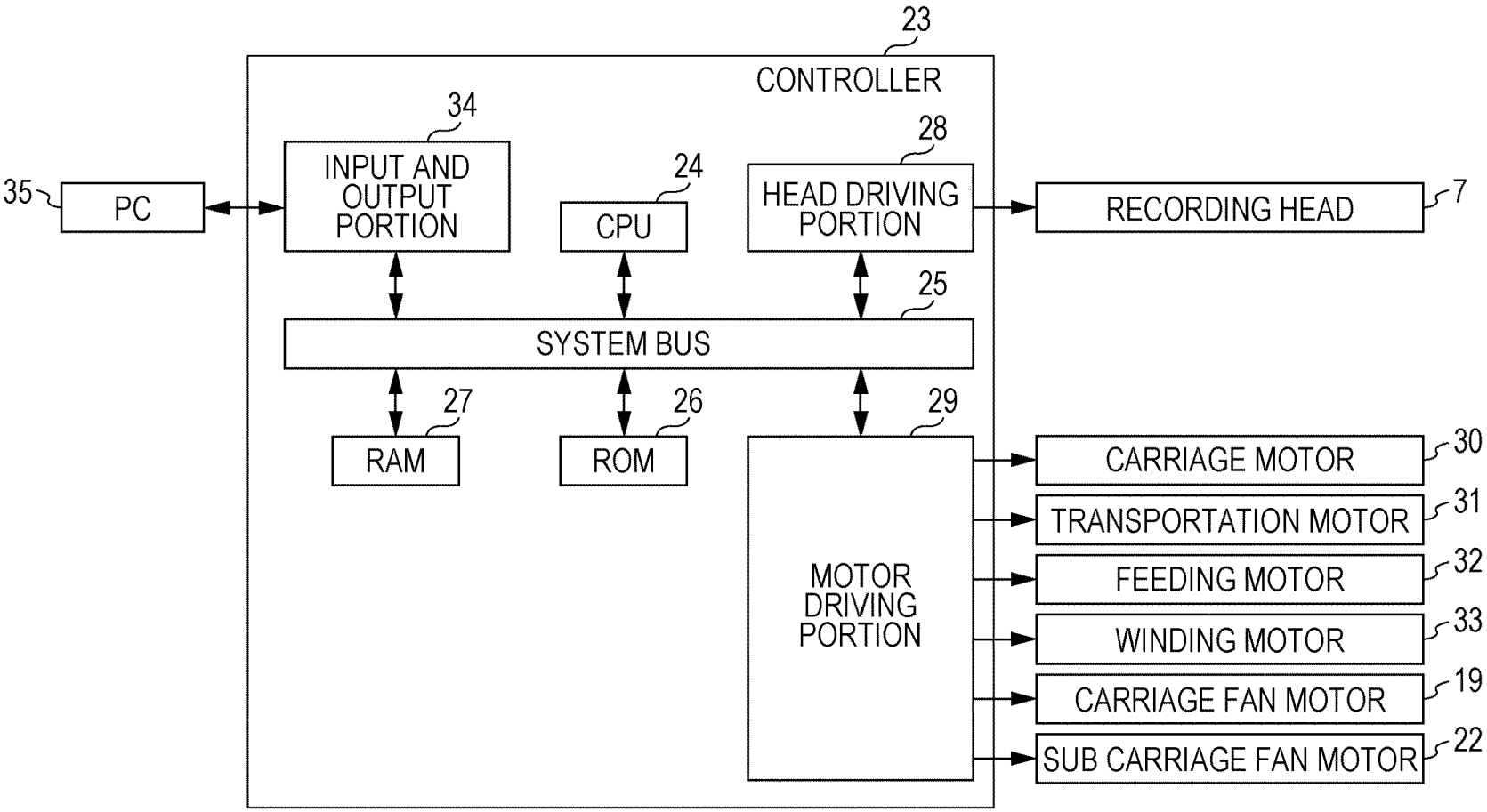
FIG. 8 is a block diagram illustrating the recording apparatus of Example 1 of the invention.

FIG. 8 is a block diagram of the recording apparatus 1 of the example.

In the controller 23, a CPU 24 which controls the entire recording apparatus 1 is provided. The CPU 24 is connected to a ROM 26 which stores various programs, and the like executed by the CPU 24 and a RAM 27 which is capable of temporary storing data through a system bus 25.

In addition, the CPU 24 is connected to a head driving portion 28 for driving the recording head 7 through the system bus 25.

In addition, the CPU 24 is connected to a motor driving portion 29, which is for driving the carriage motor 30, a transportation motor 31, a feeding motor 32, a winding motor 33, a carriage fan motor 19, and a sub-carriage fan motor 22, through the system bus 25.

Here, the carriage motor 30 is a motor for moving the carriage 6 including the recording head 7. In addition, the transportation motor 31 is a motor for driving the driving roller 8. In addition, the feeding motor 32 is a driving motor of the feeding portion for feeding the recording medium M which is set in a feeding portion (not illustrated) to the transportation mechanism 3. In addition, the winding motor 33 is a driving motor for driving a winding mechanism (not illustrated) which is for winding the recording medium M on which recording is performed. In addition, the carriage fan motor 19 is a motor for driving the carriage fan 20. Also, the sub-carriage fan motor 22 is a motor for driving the sub-carriage fan 21.

Further, the CPU 24 is connected to an input and output portion 34 through the system bus 25, and the input and output portion 34 is connected to a PC 35 for performing transmitting and receiving of data such as recording data and a signal.

Next, the shielding portion 41 and the collecting portion 15, which are main parts of the carriage 6 of the recording apparatus 1 of the example, will be described.

Figure 9:
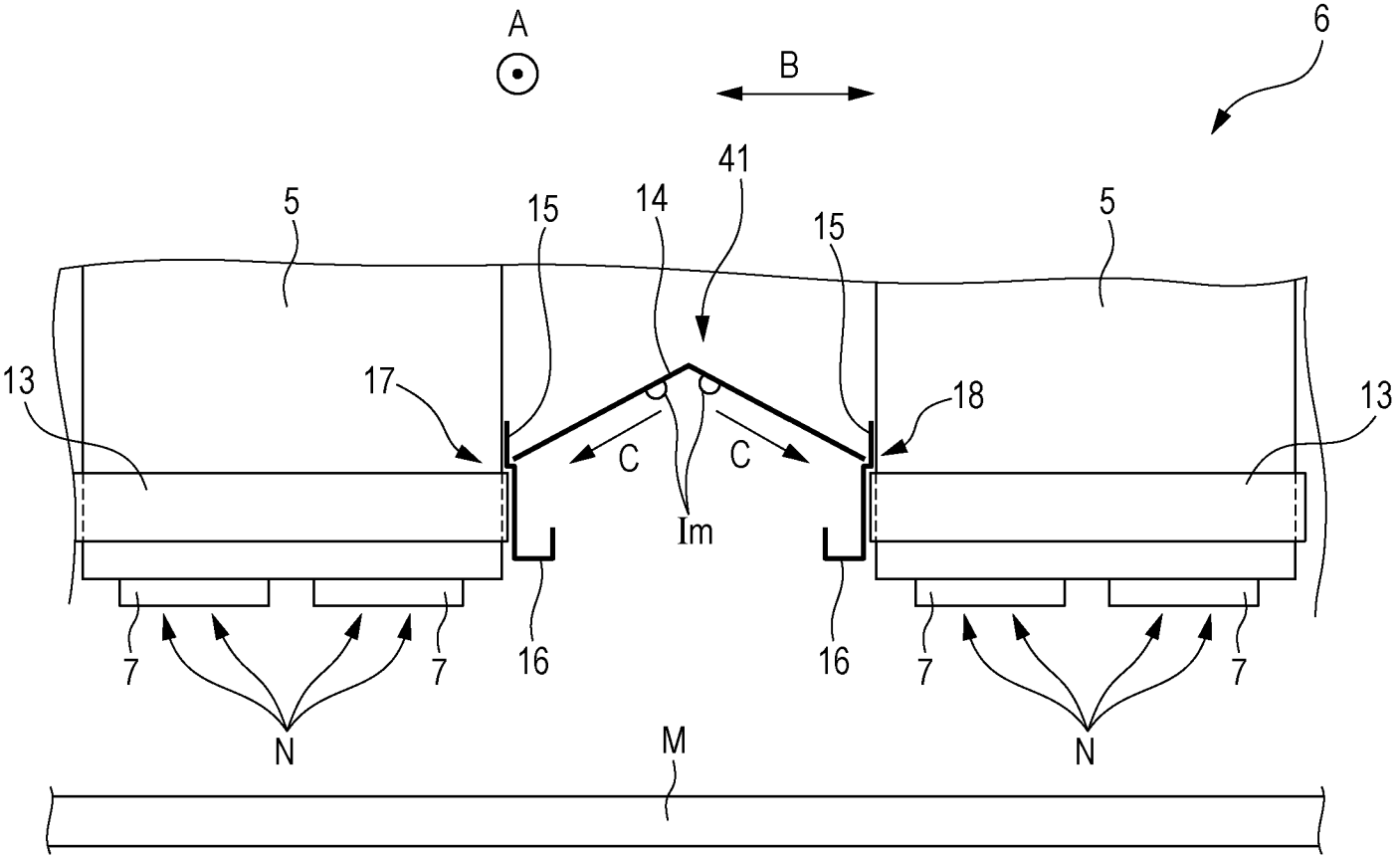
FIG. 9 is a schematic front view illustrating a main part of the carriage of the recording apparatus of Example 1 of the invention.
Figure 10:
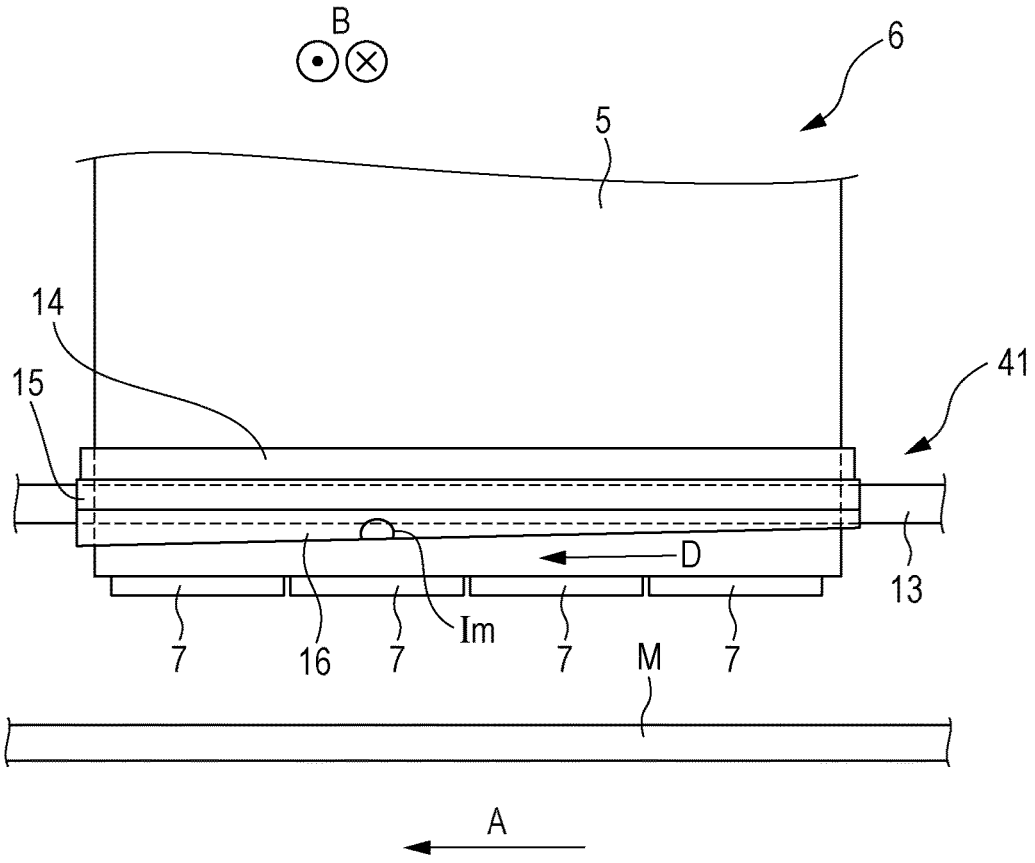
FIG. 10 is a schematic side view illustrating the main part of the carriage of the recording apparatus of Example 1 of the invention.

Here, FIG. 9 is a schematic front view illustrating a main part of the carriage 6 of the example. In addition, FIG. 10 is a schematic side view illustrating a main part of the carriage 6 of the example.

Figure 14:
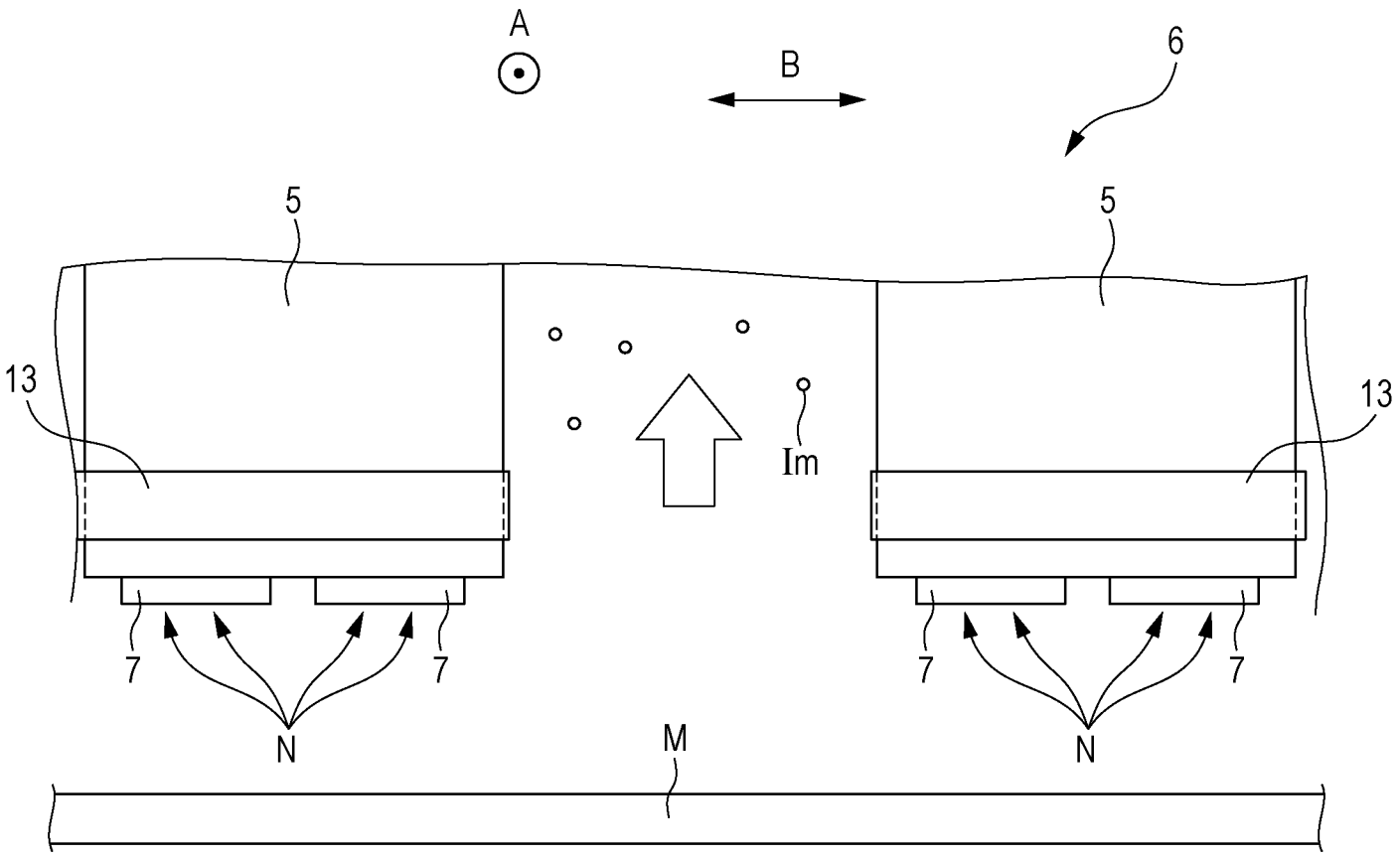
FIG. 14 is a schematic front view illustrating a main part of a carriage of a recording apparatus of Comparative example 1.
Figure 15:
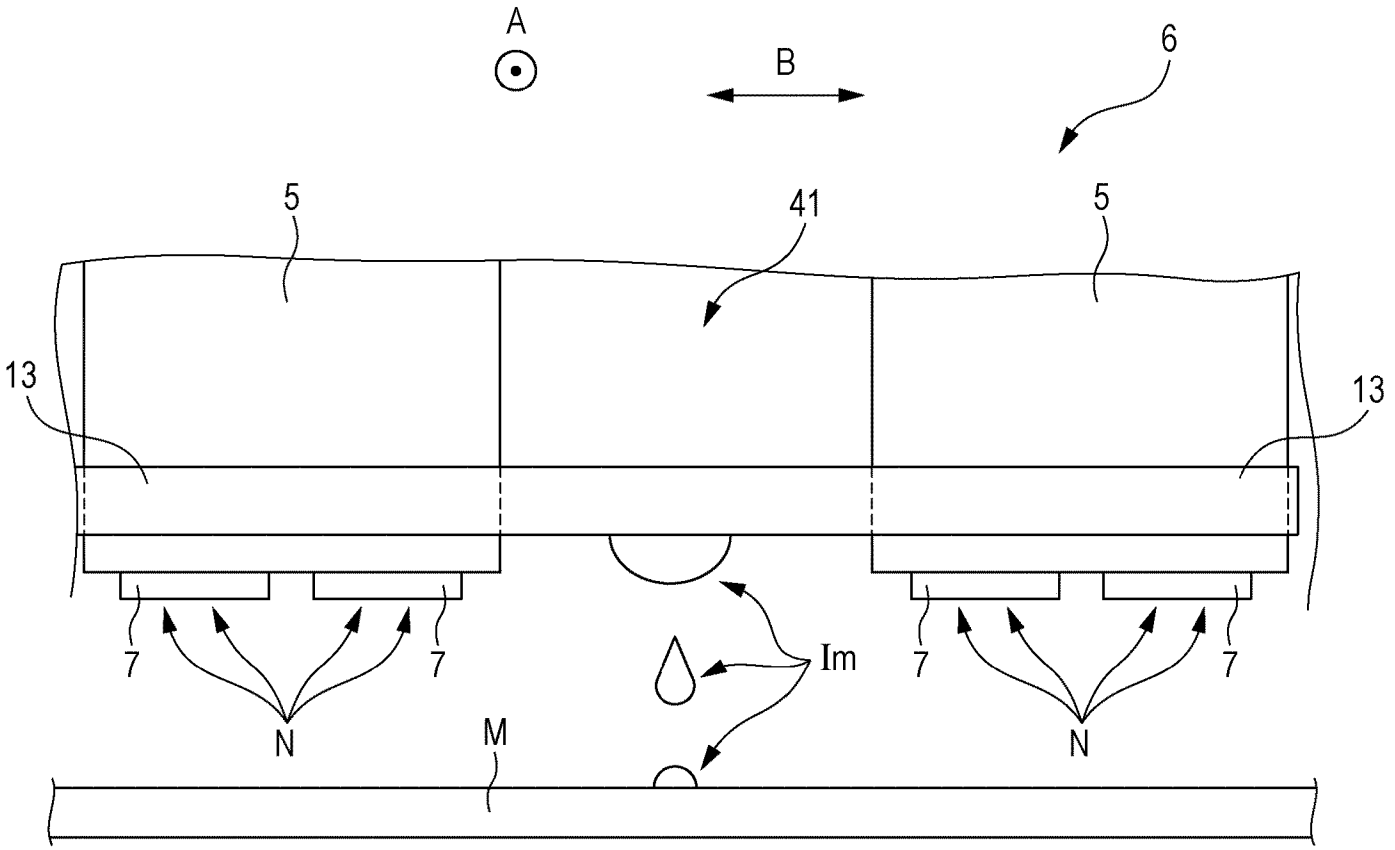
FIG. 15 is a schematic front view illustrating a main part of a carriage of a recording apparatus of Comparative example 2.

Meanwhile, FIG. 14 and FIG. 15 are schematic front views corresponding to FIG. 9 which illustrate a main part of the carriage 6 in the recording apparatus of Comparative Examples 1 and 2.

Moreover, FIG. 9, FIG. 10, FIG. 14, and FIG. 15 particularly illustrating a configuration between the adjacent sub-carriages 5, when expressed in a different manner, between the recording heads 7, further, between the nozzle rows N.

As described above, in the recording head 7 of the example, the nozzle rows N in which a plurality of nozzles capable of discharging the ink to the recording medium M are arranged in the transportation direction A are provided. In addition, in the carriage 6, a plurality of the sub-carriages 5 including a plurality of the recording heads 7 are arranged in the intersection direction B. That is, when expressed in a different manner, the carriage 6 of the example has a configuration in which the plurality of nozzles capable of discharging the ink to the recording medium M are arranged, and includes the nozzle rows N which are arranged in the intersection direction B intersecting with a nozzles-arranged direction A.

In addition, as illustrated in FIG. 9, the carriage 6 of the example includes the shielding portion 41 shielding an area between the nozzle rows N and the collecting portion 15 which collects the mist Im which is attached to the shielding portion 41 and generated due to discharging the ink from the nozzles.

Here, in the recording apparatus of Comparative example 1 which penetrates between the sub-carriages 5 in a vertical direction illustrated in FIG. 14, the mist Im of the ink is likely to be diffused upward between the sub-carriages 5 (that is, between nozzle rows N). For this reason, since the mist Im reaches the vicinity of the sub-carriage fan 21 and the mist Im is sent to the inside of the sub-carriage 5, there is concern that a defect such as attaching of the mist Im to the substrate, or the like is generated.

In addition, in the recording apparatus of Comparative example 2 in which an area between the sub-carriages 5 is shielded so as to be prevented from being vertically penetrated by the shielding portion 41 having a flat plate shape as illustrated in FIG. 15, there is concern that the mist Im remaining in the shielding portion 41, may be dropped on the recording medium M to contaminate the recording medium M.

Meanwhile, as illustrated in FIG. 9, the recording apparatus 1 of the example includes the shielding portion 41 shielding an area between the nozzle rows N and the collecting portion 15 collecting the mist Im attached to the shielding portion 41. For this reason, in the recording apparatus 1 of the example, the defect in which the ink that remains in the shielding portion 41 is dropped on the recording medium M to contaminate the recording medium M can be suppressed, when a diffusion of the mist Im of the ink is suppressed between the nozzle rows N by the shielding portion 41, and the mist Im attached to the shielding portion 41 is collected by the collecting portion 15.

In addition, as illustrated in FIG. 9, the shielding portion 41 of the example includes an inclined portion 14 which is inclined when seen from the nozzles-arranged direction A (when the recording apparatus 1 is seen from a front). For this reason, the recording apparatus 1 of the example is capable of collecting the mist Im attached to the shielding portion 41 in the collecting portion 15 by moving the mist in a direction C which is parallel to an inclination of the inclined portion 14, thereby making it possible to easily collect the mist Im by the collecting portion 15.

In addition, as illustrated in FIG. 9, the collecting portion 15 of the example is provided in a downstream side of the inclined portion 14 in the direction C where the mist Im attached to the inclined portion 14 flows. For this reason, the recording apparatus 1 of the example is capable of easily collecting the mist Im collected along the inclination of the inclined portion 14 in the collecting portion 15.

In addition, as illustrated in FIG. 9, the shielding portion 41 of the example is formed so that the center side between the nozzle rows N forms a high position and the end portion sides thereof form low positions. That is, the mist Im attached to the inclined portion 14 flows from a center side between the nozzle rows N to an end portion side. For this reason, the recording apparatus 1 of the example is capable of reducing the deviation in a collected amount of the mist Im which is collected on both sides between the nozzle rows N in the both sides thereof.

In addition, as illustrated in FIG. 9, the collecting portion 15 of the example includes a bending portion 18, and is capable of hooking the bending portion 18 with respect to a protrusion portion 17 of a supporting portion 13 for the sub-carriage 5 in the carriage 6. According to such a configuration, the collecting portion 15 of the example can be attached to and detached from the carriage 6. For this reason, the recording apparatus 1 of the example is capable of simply removing the ink (mist Im) which is collected in the collecting portion 15.

In addition, as illustrated in FIG. 9, the shielding portion 41 of the example can be hooked in the bending portion 18 of the collecting portion 15. According to such a configuration, the shielding portion 41 of the example can be detached from the carriage 6. For this reason, the recording apparatus 1 of the example is capable of improving workability at the time of providing the sub-carriage 5 in the carriage 6, or the like.

In addition, as illustrated in FIG. 9 and FIG. 10, the collecting portion 15 of the example includes groove portions 16 which extends in the nozzles-arranged direction A and receives the ink. Also, as illustrated in FIG. 10, the groove portion 16 is inclined when seen from the intersection direction B (when the recording apparatus 1 is seen from a side). Specifically, the groove portion 16 is lowered from the upstream side toward the downstream side of the transportation direction A. For this reason, in the recording apparatus 1 of the example, the ink remaining in the groove portion 16 is moved in a direction D, and the ink (mist Im) is collected on a downstream side in the transportation direction A of the groove portion 16, which is one end side of the nozzles-arranged direction A of the groove portion 16, the ink remaining in the groove portion 16 can be simply removed from the one end side thereof.

In detail, the recording apparatus 1 of the example includes the carriage 6, which are provided with the nozzle rows N, the shielding portion 41, and the collecting portion 15 and can be reciprocated in the intersection direction B; however, when the carriage 6 is positioned in a holding position (home position) of the carriage 6 in a reciprocating range of the carriage 6, a removing portion (not illustrated) which removes the ink received in the groove portion 16 from the groove portion 16 (the ink remaining on the downstream side in the transportation direction A of the groove portion 16 is removed) is provided in the recording apparatus.

When expressed in a different manner, in the recording apparatus 1 of the example, when the carriage 6 is positioned in the home position, the ink received in the groove portion 16 from the groove portion 16 can be removed. Therefore, the ink (mist Im) remaining in the groove portion 16 can be simply and accurately removed.

Example 2

FIG. 11

Next, the recording apparatus according to Example 2 of the invention will be described.

Figure 11:
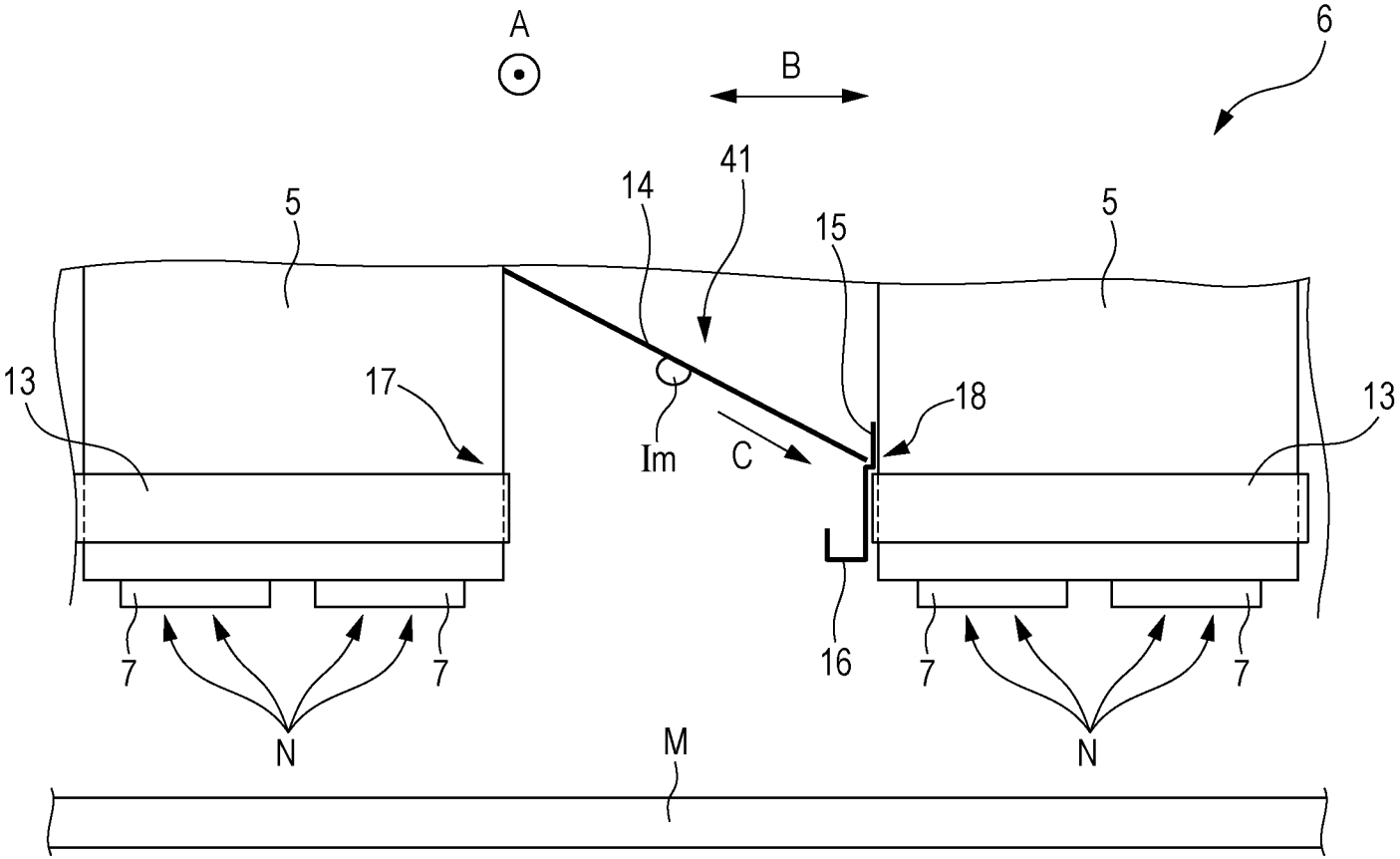
FIG. 11 is a schematic front view illustrating a main part of a carriage of a recording apparatus of Example 2 of the invention.

FIG. 11 is a schematic front view illustrating a main part of the carriage 6 of the recording apparatus 1 according to Example 2 of the invention, and corresponds to FIG. 9 illustrating a main part of the carriage 6 of the recording apparatus 1 of Example 1.

Moreover, configuration members common to that of Example 1 are expressed by the same numerals, and detailed descriptions thereof will not be repeated.

The recording apparatus 1 of the example only has a difference in configuration of the collecting portion 15 and the shielding portion 41, which are main parts of the recording apparatus 1 of the example, from the recording apparatus 1 of Example 1.

As illustrated in FIG. 9, in the shielding portion 41 of Example 1, the center side between the nozzle rows N forms a high position and the end portion sides form low positions.

Meanwhile, as illustrated in FIG. 11, one end side of the shielding portion 41 of the example forms a high position and the other end portion side thereof forms a low position in the intersecting direction. When expressed in a different manner, the shielding portion 41 of the example has a shape in which the mist Im attached to the inclined portion 14 flows from one nozzle row N among the nozzle rows N toward the other nozzle rows N. For this reason, in the recording apparatus 1 of the example, the collecting portion 15 may be provided singularly with respect to one of the nozzle rows N, and a configuration of the carriage 6 is simple.

Example 3

FIG. 12

Next, the recording apparatus according to Example 3 of the invention will be described.

Figure 12:
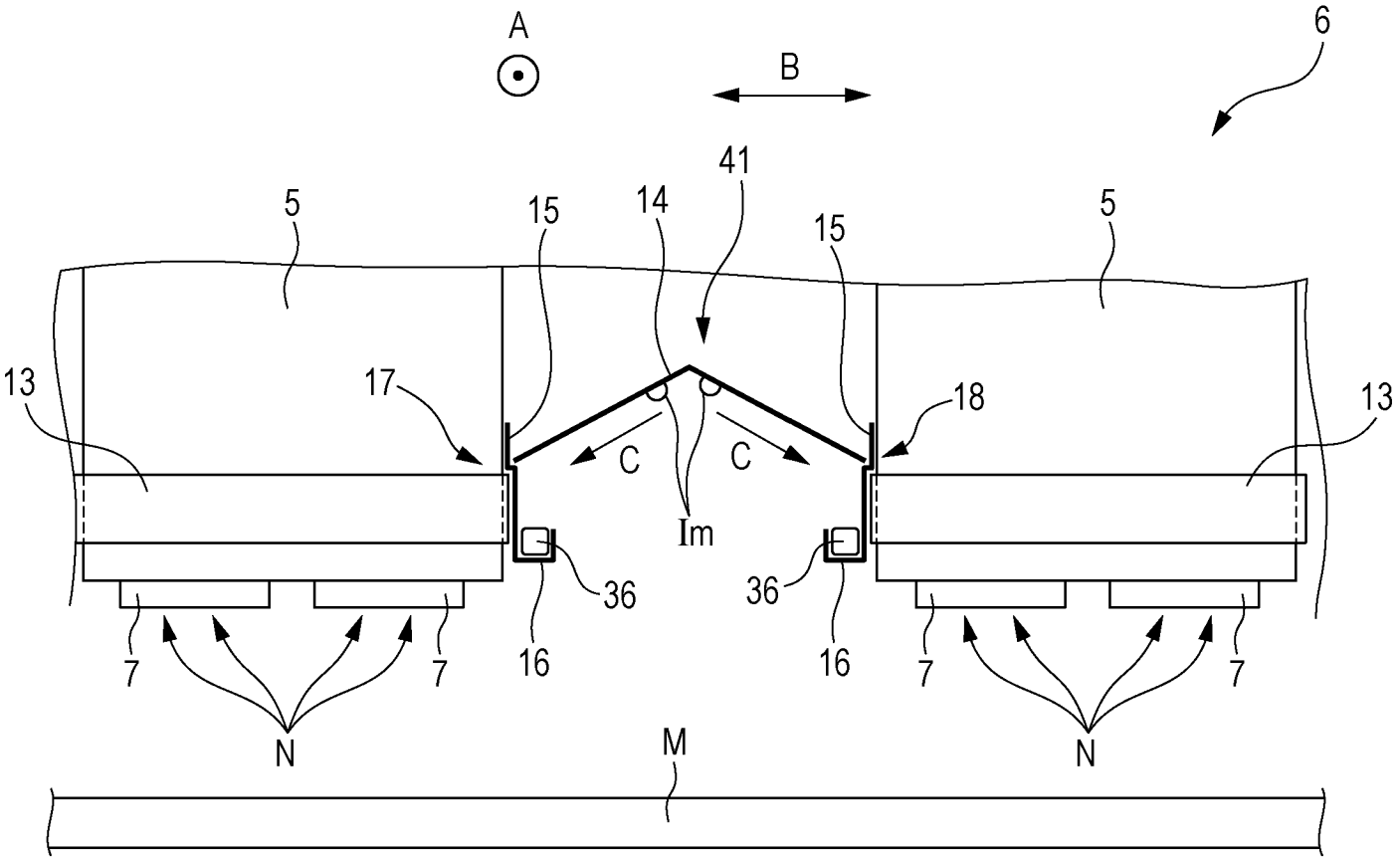
FIG. 12 is a schematic front view illustrating a main part of a carriage of a recording apparatus of Example 3 of the invention.

FIG. 12 is a schematic front view illustrating a main part of the carriage 6 of the recording apparatus 1 of Example 3 of the invention, and corresponds to FIG. 9 illustrating a main part of the carriage 6 of the recording apparatus 1 of Example 1.

Moreover, configuration members common to that of Example 1 are expressed by the same numerals, and detailed descriptions thereof will not be repeated.

The recording apparatus 1 of the example has a different configuration of the collecting portion 15 which is a main part of the recording apparatus 1 of the example, in detail, only a configuration in which an absorbing member 36 is included in the groove portion 16 is different from that of the recording apparatus 1 of Example 1.

As illustrated in FIG. 12, the collecting portion 15 of the example includes the absorbing member 36 which absorbs the ink in the groove portion 16. For this reason, the recording apparatus 1 of the example is capable of suppressing the defect of pollution inside of the recording apparatus 1, such as spilling of the ink collected by the collecting portion 15, or the like.

Here, the absorbing member 36 of the example can be detached from the groove portion 16 (carriage 6). Therefore, when an absorbing performance of the ink (mist Im) of the absorbing member 36 is deteriorated, or the like, the absorbing member 36 can be simply exchanged.

Example 4

FIG. 13

Next, a recording apparatus according to Example 4 of the invention will be described.

Figure 13:
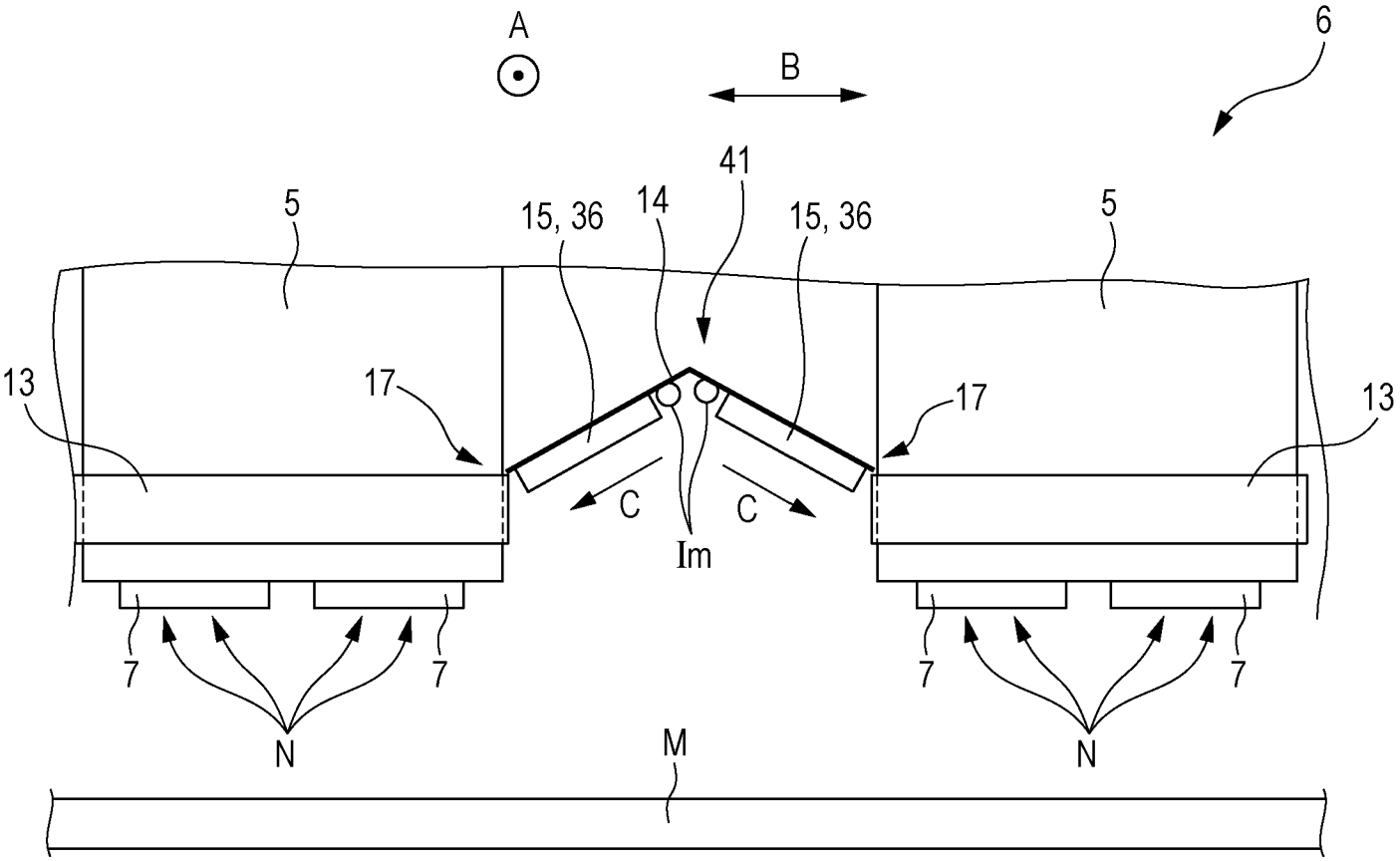
FIG. 13 is a schematic front view illustrating a main part of the carriage of the recording apparatus of Example 3 of the invention.

FIG. 13 is a schematic front view of a main part of the carriage 6 of the recording apparatus 1 according to Example 3 of the invention, and corresponds to FIG. 9 illustrating a main part of the carriage 6 of the recording apparatus 1 of Example 1.

Moreover, configuration members common to that of Example 1 are expressed by the same numerals, and detailed descriptions thereof will not be repeated.

The recording apparatus 1 of the example only has a difference in configuration of the collecting portion 15 and the shielding portion 41, which are main parts of the recording apparatus 1 of the example, from the recording apparatus 1 of Example 1.

As illustrated in FIG. 13, the collecting portion 15 of the example is the absorbing member 36 which is bonded to the inclined portion 14. For this reason, the collecting portion 15 can be simply configured.

Moreover, the absorbing member 36 of the example can be also detached from the carriage 6, in the same way as the absorbing member of the recording apparatus 1 of Example 3. For this reason, when an absorbing performance (mist Im) of the ink of the absorbing member 36 is deteriorated, or the like, the absorbing member 36 can be simply exchanged.

Moreover, the invention is not limited to the above examples, and can be variously deformed within a range of inventions disclosed in claims. It is needless to say that these are also included in the range of the invention.

Hitherto, the invention has been described in detail on the basis of the specific examples. Here, an outline of the invention will be described again.

The liquid discharging apparatus 1 of a first aspect of the invention includes the nozzle rows N, in which the plurality of nozzles capable of discharging liquid onto a medium M are arranged, and that are arranged in multiple in the intersection direction B intersecting with the nozzles-arranged direction A where the nozzles are arranged, the shielding portion 41 which shields an area between the nozzle rows N, and the collecting portion 15 which is attached to the shielding portion 41 and collects the mist Im generated due to discharging of the liquid from the nozzles.

According to the aspect, the shielding portion 41 shielding an area between the nozzle rows and the collecting portion 15 collecting the mist Im attached to the shielding portion 41 are provided. Therefore, since diffusion of the mist Im of the liquid between the nozzle rows N can be suppressed by the shielding portion 41, and the mist Im attached to the shielding portion 41 is collected by the collecting portion 15, the defect of pollution of the medium M, the liquid remaining in the shielding portion 41 is dropped on in the medium M can be suppressed.

In the liquid discharging apparatus 1 of a second aspect of the invention according to the first aspect, the shielding portion 41 includes the inclined portion 14 which is inclined when seen from the nozzles-arranged direction A.

According to the aspect, the shielding portion 41 includes the inclined portion 14 which is inclined when seen from the nozzles-arranged direction A. For this reason, the mist Im attached to the shielding portion 41 can be collected along the inclination of the inclined portion 14, and the mist Im can be easily collected by the collecting portion 15.

In the liquid discharging apparatus 1 of a third aspect of the invention according to the second aspect, the collecting portion 15 is provided on a downstream side of the inclined portion 14 in the direction C where the mist Im attached to the inclined portion 14 flows.

According to the aspect, the collecting portion 15 is provided on a downstream side of the inclined portion 14 in the direction C where the mist Im attached to the inclined portion 14 flows. Therefore, the mist Im which is collected along the inclination of the inclined portion 14 can be easily collected by the collecting portion 15.

In the liquid discharging apparatus 1 of a fourth aspect of the invention according to the second aspect or the third aspect, the shielding portion 41 has a shape in which the mist Im attached to the inclined portion 14 flows from the center side to the end portion side of the nozzle rows N.

According to the aspect, the shielding portion 41 has a shape in which the mist Im attached to the inclined portion 14 flows from the center side to the end portion side of the nozzle rows N. For this reason, a deviation of the collected amount of the mist Im which is collected to both sides of the nozzle rows N can be reduced in the both sides.

In the liquid discharging apparatus 1 of a fifth aspect of the invention according to the second aspect or the third aspect, the shielding portion 41 has a shape in which the mist Im attached to the inclined portion 14 flows from one nozzle row N among the nozzle rows N toward the other nozzle rows N.

According to the aspect, the shielding portion 41 has a shape in which the mist Im attached to the inclined portion 14 flows from one nozzle row N among the nozzle rows N toward the other nozzle rows N. Therefore, one collecting portion 15 is provided on one nozzle of the nozzle rows N, thereby making it possible to simplify the configuration thereof.

In the liquid discharging apparatus 1 of a sixth aspect of the invention according to any one of the first aspect to the fifth aspect, the collecting portion 15 is detachable.

According to the aspect, the collecting portion 15 is detachable. Therefore, the liquid (mist Im) which is collected by the collecting portion 15 can be simply removed.

In the liquid discharging apparatus 1 of a seventh aspect of the invention according to any one of the first aspect to the sixth aspect, the collecting portion 15 includes the groove portion 16 which extends in the nozzles-arranged direction A and receives the liquid, and the groove portion 16 is inclined when seen from the intersection direction B.

According to the aspect, the collecting portion 15 includes the groove portion 16 which extends in the nozzles-arranged direction A and receives the liquid, and the groove portion 16 is inclined when seen from the intersection direction B. Therefore, the liquid (mist Im) remaining in the groove portion 16 can be simply removed from one end side of the nozzles-arranged direction A of the groove portion 16.

The liquid discharging apparatus 1 of an eighth aspect of the invention according to the seventh aspect, further includes the carriage 6, in which the nozzle rows N, the collecting portion 15 and the shielding portion 41 are provided, which is capable of being reciprocated in the intersection direction B, in which when the carriage 6 is positioned at a holding position in a reciprocating range of the carriage 6, the liquid received in the groove portion 16 is removable from the groove portion 16.

According to the aspect, when the carriage 6 is positioned at a holding position in a reciprocating range of the carriage 6, the liquid received in the groove portion 16 can be removed from the groove portion 16. Therefore, a removing portion, which can remove the liquid (mist Im) remaining in the groove portion 16 from one end side of the nozzles-arranged direction A of the groove portion 16, is provided in the holding position of the carriage 6, and thus, the liquid (mist Im) remaining in the groove portion 16 can be simply and easily removed.

In the liquid discharging apparatus 1 of a ninth aspect of the invention according to any one of the first aspect to the eighth aspect, the collecting portion 15 includes an absorbing member 36 which absorbs the liquid.

According to the aspect, the collecting portion 15 includes an absorbing member 36 which absorbs the liquid. Therefore, the defect, such as pollution of the inside of the liquid discharging apparatus 1 due to for example, spilling of the liquid collected by the collecting portion 15, can be suppressed.

In the liquid discharging apparatus 1 of a tenth aspect of the invention according to the ninth aspect, the collecting portion 15 is the absorbing member 36 which is bonded to the inclined portion 14.

According to the aspect, the collecting portion 15 is the absorbing member 36 which is bonded to the inclined portion 14. Therefore, the collecting portion 15 can be simply configured.

In the liquid discharging apparatus 1 of an eleventh aspect of the invention according to the ninth aspect or the tenth aspect, the absorbing member 36 is detachable.

According to the aspect, the absorbing member 36 is detachable. Therefore, when absorbing performance of the liquid (mist Im) of the absorbing member 36 becomes deteriorated, or the like, the absorbing member 36 can be simply exchanged.

The entire disclosure of Japanese Patent Application No. 2015-063917, filed Mar. 26, 2015 is expressly incorporated by reference herein.

What is claimed is:

1. A liquid discharging apparatus comprising:

nozzle rows, in which a plurality of nozzles capable of discharging liquid onto a medium are arranged, that are arranged in multiple in an intersection direction intersecting with a nozzles-arranged direction where the nozzles are arranged;

a shielding portion that is disposed between the nozzle rows and that shields an area between the nozzle rows; and a collecting portion that collects mist which is attached to the shielding portion and is generated due to discharging of the liquid from the nozzles.

2. The liquid discharging apparatus according to claim 1, wherein the shielding portion includes an inclined portion which is inclined when seen from the nozzles-arranged direction.

3. The liquid discharging apparatus according to claim 2, wherein the collecting portion is provided on a downstream side of the inclined portion in a direction where the mist attached to the inclined portion flows.

4. The liquid discharging apparatus according to claim 2, wherein the shielding portion has a shape in which the mist attached to the inclined portion flows from a center side to an end portion side of the nozzle rows.

5. The liquid discharging apparatus according to claim 2, wherein the shielding portion has a shape in which the mist attached to the inclined portion flows from one nozzle row among the nozzle rows toward the other nozzle rows.

6. The liquid discharging apparatus according to claim 1, wherein the collecting portion is detachable.

7. The liquid discharging apparatus according to claim 1, wherein the collecting portion includes a groove portion which extends in the nozzles-arranged direction and receives the liquid, and wherein the groove portion is inclined when seen from the intersection direction.

8. The liquid discharging apparatus according to claim 7, further comprising:

a carriage, in which the nozzle rows, the shielding portion, and the collecting portion are provided, that is capable of being reciprocated in the intersection direction, wherein when the carriage is positioned at a holding position in a reciprocating range of the carriage, the liquid received in the groove portion is removable from the groove portion.

9. The liquid discharging apparatus according to claim 1, wherein the collecting portion includes an absorbing member which absorbs the liquid.

10. The liquid discharging apparatus according to claim 9, wherein the collecting portion is the absorbing member which is bonded to the inclined portion.

11. The liquid discharging apparatus according to claim 9, wherein the absorbing member is detachable.

* * * * *